US008172111B1

(12) United States Patent
Fowler et al.

(10) Patent No.: US 8,172,111 B1
(45) Date of Patent: May 8, 2012

(54) LIQUID CAPTURE DEVICE

(76) Inventors: Janice K. Fowler, Holdrege, NE (US); Bonnie Young, Holdrege, NE (US)

( * ) Notice: Subject to any disclaimer, the term of this patent is extended or adjusted under 35 U.S.C. 154(b) by 773 days.

(21) Appl. No.: 12/218,876

(22) Filed: Jul. 17, 2008

Related U.S. Application Data

(63) Continuation-in-part of application No. 11/101,306, filed on Apr. 7, 2005, now Pat. No. 7,513,392.

(51) Int. Cl.
*B67D 1/16* (2006.01)

(52) U.S. Cl. ..... 222/108; 141/86; 137/313

(58) Field of Classification Search ..... 222/108; 141/86, 88; 137/313
See application file for complete search history.

(56) References Cited

U.S. PATENT DOCUMENTS 163,481 A * 5/1875 Gray ..... 222/108
5,960,995 A * 10/1999 Leatherman et al. ..... 222/108

* cited by examiner

*Primary Examiner* — Kevin P Shaver
*Assistant Examiner* — Melvin Cartagena
(74) *Attorney, Agent, or Firm* — Stan Collier, Esq

(57) ABSTRACT

The liquid capture device has a horizontal support resting upon a support surface having a front edge in close proximity to the edge of a table. A vertical support member has a second connecting top edge. The first and second connecting devices are complementary to each other. On the lower portion of the vertical support member is a liquid receiving means. The liquid receiving means is located under a spigot so any dripping liquid is captured. The liquid receiving means may also include a corrugated floor. In one embodiment, the vertical support member can be removed from the horizontal support member to empty excess liquid. The connecting means may be a hooking member over a pin; or a magnet. In another embodiment, the connecting means may be a hinge and pin or a flexible hinge. This allows the vertical member to rotate for liquid to flow out through an exit.

1 Claim, 7 Drawing Sheets

LIQUID CAPTURE DEVICE

CROSS-REFERENCE TO RELATED APPLICATIONS

This patent application is a continuation-in-part of patent application Ser. No. 11/101,306 being US 2006/0226172 A1 publication, filed Apr. 7, 2005 now U.S. Pat. No. 7,513,392, entitled "Fluid Capture Apparatus" and is incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable.

BACKGROUND OF THE INVENTION

1. Field of the Invention

The present invention relates generally to liquid dispensers, and, particularly, to liquid dispensers having a spout or spigot type of liquid dispensing device, and, more particularly, relates to an improved liquid capture apparatus that is positioned in proximity to the liquid dispenser.

2. Description of the Prior Art

Liquid dispensing devices are well known in the art, and, in particular, devices that standalone. These devices are used at meetings, conferences, picnics, sporting events, weddings, or other gatherings where a significant number of people are present. These devices normally are used for dispensing hot and cold fluids like coffee, hot water, cold water, orange juice, etc. These devices typically are positioned on a table being a support surface near the front edge of the table so the liquid controlling device such as a spigot is easily accessible. A cup or glass is normally positioned under the spigot to receive the fluid. The table may also serve as a support for the cup or glass as the liquid is being dispensed or the cup or glass may be hand-held thereunder. The dispensing device may also be placed on a stand on the table to raise the spigot to a higher position. For many reasons, the liquid may further end up on the table or floor by accident or by poor design of the liquid controlling device not closing properly.

One problem with the liquid controlling device on the liquid dispensing device is that they tend to drip. This results from the spigot, for example, not seating properly. Also, liquid may still remain in the spigot after a control device is closed.

The dripping and/or spilling is undesirable as it creates a mess and/or a potentially dangerous situation. Stains on a tablecloth look unsightly and liquid on the floor can lead to a person slipping and falling.

One prior solution is the use of a drip pan or container on the table under the spigot. This requires that the liquid dispensing device be positioned well away from the edge of the table. Users thus must lean over to open the spigot that may lead to more spilling.

One possible solution to this problem is presented in prior art patents U.S. Pat. No. 7,216,778; U.S. Pat. No. 6,279,781; and U.S. Pat. No. 5,470,011 which are incorporated by reference. As seen therein, a liquid capture device is removably connected to the spigot and hangs over the table edge. A liquid reservoir at the bottom of the liquid capture device holds the dripping liquid or spilled liquid until being emptied. One problem with these devices is that the device is not securely held by the spigot and can swing back and forth thus allowing the liquid to splash therefrom when bumped. Removing the device from the spigot may also result in spills since parts of the spigot may interfere in the removal.

Accordingly, there is an established need for an improved liquid capture device that prevents spills and is easily emptied.

SUMMARY OF THE INVENTION

The present invention is directed at an improved liquid capture device.

The improved liquid capture device has a horizontal support member that rests upon a support surface such as provided by a table having a front edge. The edge side of the horizontal support member has a first connecting device in close proximity to the edge of the table when in use. A vertical support member of the liquid capture device has a second connecting device at a top edge. The first and second connecting devices are complementary to each other and when connected form a connecting means for holding the vertical support member to the horizontal support member. On the lower portion of the vertical support member is a liquid receiving means. The liquid receiving means is located under the spigot of the liquid dispensing means when in use so that any dripping liquid is captured therein. The liquid receiving means may also include a corrugated floor. In one embodiment, the vertical support member can be removed from the horizontal support member to empty excess liquid therein. The connecting means may be hooking members over a pin; or may be a magnet. In another embodiment, the connecting means may be a hinge and pin therein or may be a flexible hinge. This allows the vertical member to be rotated to cause the liquid therein to flow out through an exit means.

An object of the present invention is to provide, an improved liquid capture device for a liquid dispensing means that is not directly or indirectly connected to the liquid dispensing means.

It is another object of the present invention to provide an improved liquid capture device that allows for ease of removal of any captured liquid.

It is a further object of the present invention to provide an improved liquid capture device that allows for the positioning of a drinking cup or glass thereon.

It is still a further object of the present invention to provide an improved liquid capture device that is easily mounted to a support surface such as a table.

It is yet a further object of the present invention to provide an improved liquid capture device wherein a spigot of the liquid dispensing device need not be directly over the liquid receiving means.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIGS. 2A and 28 illustrate by a side view cross section a corrugated floor of a liquid receiving device of the present invention, and a corrugated floor insert;

Like reference numerals refer to like parts throughout the several views of the drawings.

DETAILED DESCRIPTION OF THE PREFERRED EMBODIMENTS

The present invention is directed at an improved liquid capture device for use with liquid dispensers.

The improved liquid capture device has a horizontal support member that rests upon a support surface such as provided by a table having a front edge. A front edge side of the horizontal support member has a first connecting device in close proximity to the edge of the table when in use. A vertical support member of the liquid capture device has a second connecting device at a top edge of a top section. The first and second connecting devices are complementary to each other and when connected form a flexible connecting means for holding the vertical support member to the horizontal support member. On a lower portion of the vertical support member is a liquid receiving device. The liquid receiving device may be located under the spigot of the liquid dispensing means when in use so that any dripping liquid is captured therein. The liquid receiving device may also include a corrugated floor. In one embodiment, the vertical support member can be removed from the horizontal support member to empty excess liquid from the liquid receiving device. The connecting means may be hooking members over a pin; or may be a magnet. In another embodiment, the connecting means may be a hinge and pin therein or may be a flexible hinge. This allows the vertical member to be rotated to cause the liquid therein to flow out through an exit means. A further benefit of the hinged members is that a more compact storage configuration is allowed.

Figure 1A:
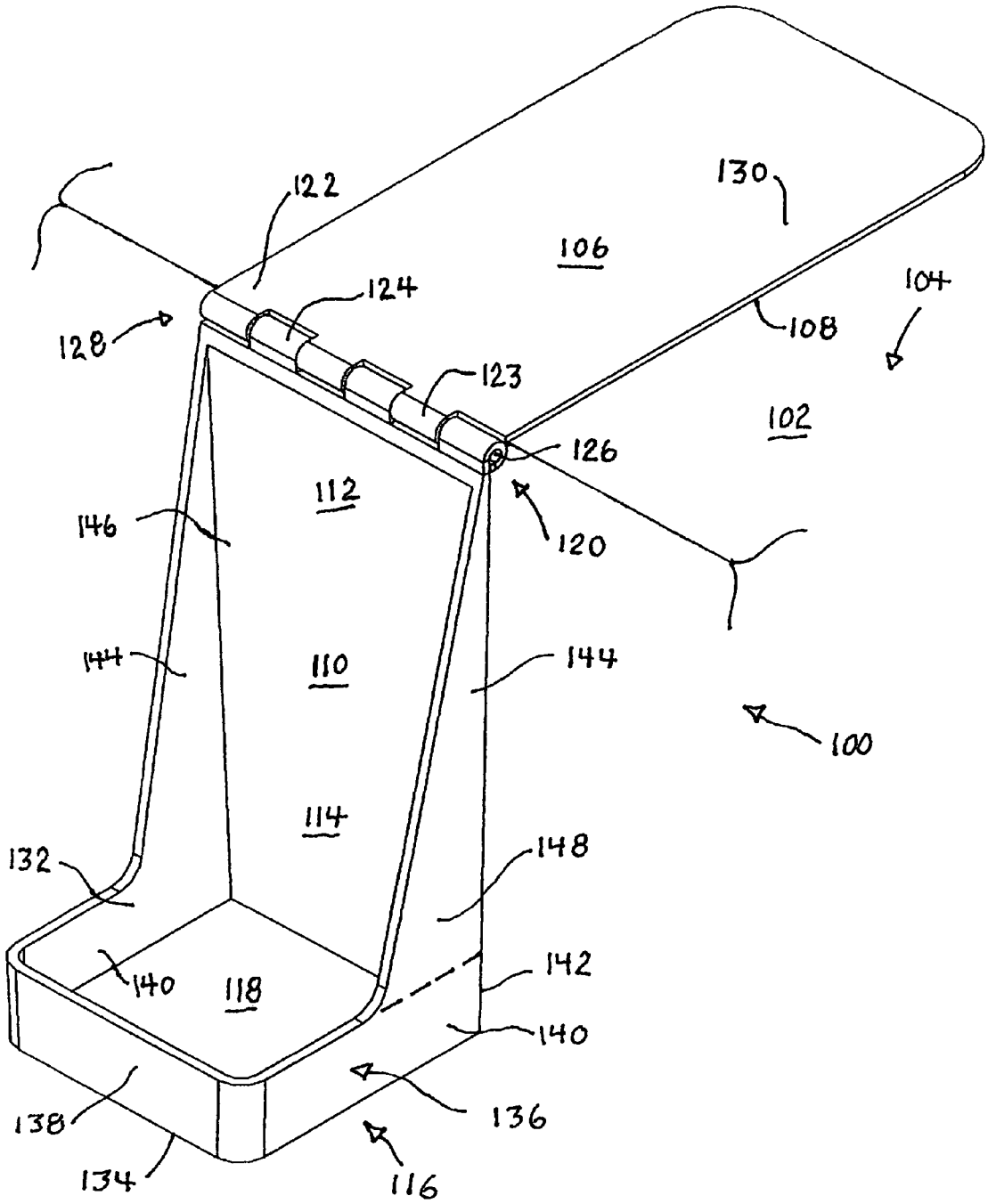
FIG. 1A is a perspective view of a preferred embodiment of a liquid capture device of the present invention having a hinged edge.

Turning to the drawings, wherein like components are designated by like reference numerals throughout the various figures, attention is initially directed to FIG. 1A which illustrates a perspective view of a liquid capture device 100 constructed according to the present invention.

Figure 1B:
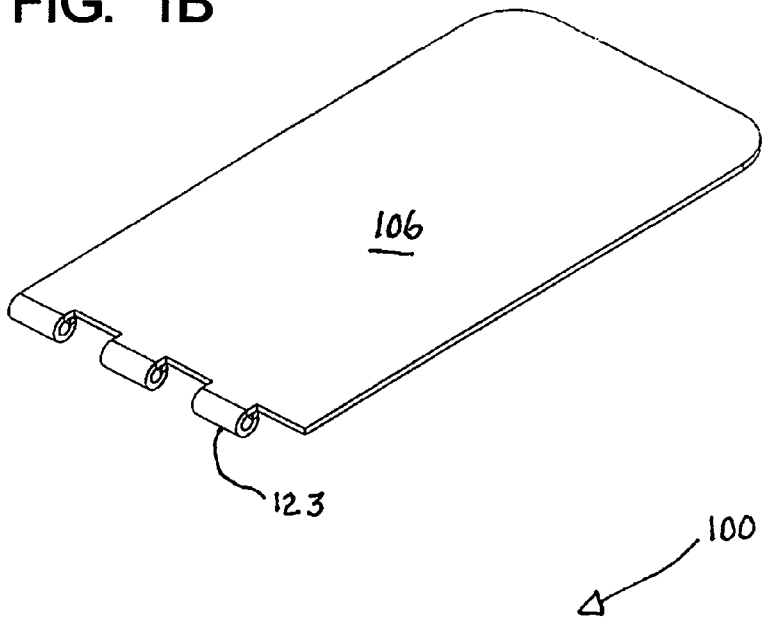
FIG. 1B is a perspective view of the horizontal support member removed from the vertical support member of the liquid capture device of present invention as shown in FIG. 1A.
Figure 1B:
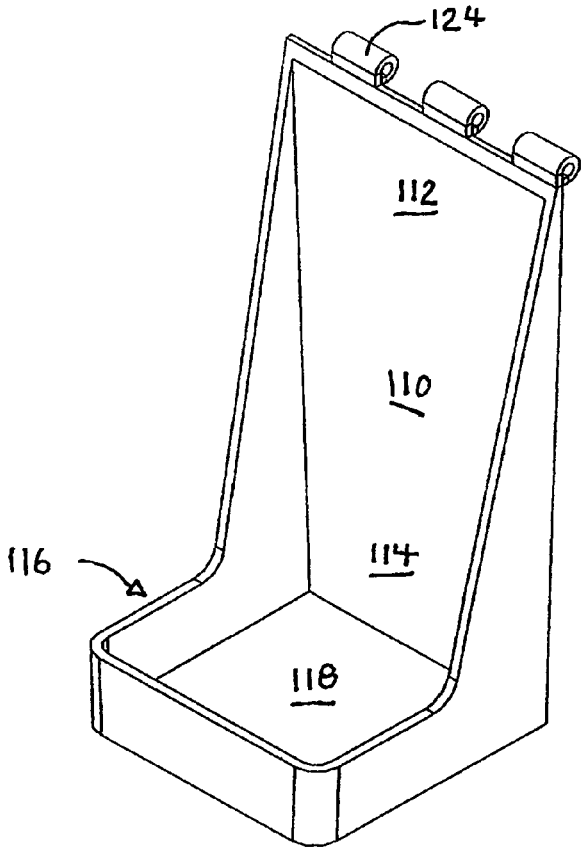

As best shown in FIGS. 1A and 1B, the improved liquid capture device 100 is for use with a conventional liquid dispenser having a spigot, (see FIG. 6), being positioned upon a support surface 102 of a support structure 104 such as a table when in use. The liquid capture device 100 has a horizontal support member 106 that rests upon the structure 104 when in use. The use of the word "horizontal" or "vertical" is used merely to describe the general orientation of the object and is not a requirement that the object be in that exact direction to work properly unless specifically stated. The horizontal support member 106 may be a panel having a flat lower side 108 that is in contact with the support surface 102 when in use. Further, the panel may have both a flat upper side 130 and the flat lower side 108.

A vertical support member 110 has a top section 112 and bottom section 114. A liquid receiving device 116 is attached to the bottom section 114 of the vertical support member 110. The liquid receiving device 116 provides a reservoir 118 into which certain liquid from the liquid dispenser may be collected. A means for flexibly connecting 120 the vertical support member 110 to the horizontal support member 106 is provided in accordance with the invention.

The liquid capture device 100 has a front side edge 122 on the horizontal support member 106 where a first means for connecting 123 is attached. These are a plurality of tubes that are normally integrally attached to the horizontal support member 106 during the manufacturing process. The tubes are spaced apart a sufficient distance to allow similarly shaped tubes of a second means for connecting 124 to be inserted together and a hinge pin 126 inserted through the tubes to form the hinge 128. The hinge pin 126 may be permanently installed therein or may be removable. The second means for connecting 124 is similarly constructed as the first means for connecting 123 and is attached to the top section 112 of the vertical support member 110.

Having an essentially right angle formed between the horizontal support member 106 and the vertical support member 110 by a flexible connecting means allows the liquid capture device 100 to be positioned on a table near the edge and remain there without further support. The liquid dispenser does not have to sit upon the horizontal member 106. This is accomplished by the having the hinge as close to the edge of the table as possible. Thus the weight of the vertical support member 110 with the liquid receiving device 116 has a very short lever arm while the weight of the horizontal support member 106 has a much greater lever arm from the hinge pivot point.

The liquid receiving device 116 comprises a container having an open top 132, a closed bottom 134, and one or more walls 136 between the open top 132 and the closed bottom 134. There may be a front wall 138, two sidewalls 140 and a back wall 142.

To further aid in channeling dripping liquid into the reservoir 118, the vertical support member 110 may include sidewalls 144 attached to vertical outer edges 146. The sidewalls 144 may be generally shaped as triangular with lower sections 148 merging into the sidewalls 140 of the liquid receiving device 116.

Figure 2A:
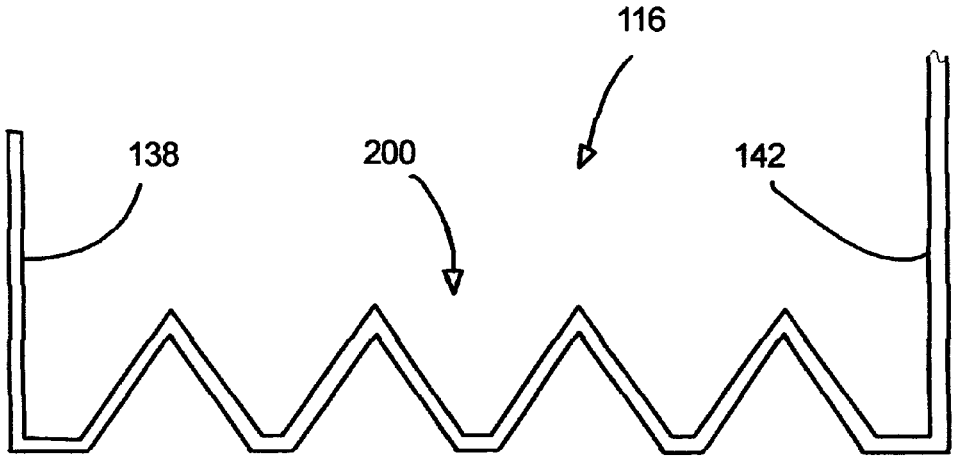
Figure 2B:
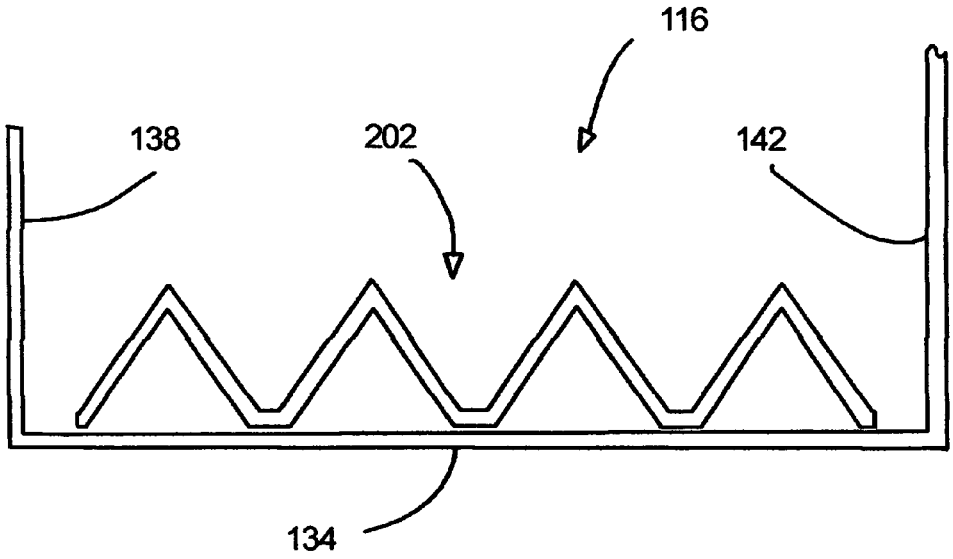

Referring to FIGS. 2A and 2B, the improved liquid capture device 100 may further include a corrugated bottom 200 as shown by cross section in FIG. 2A, or may include a corrugated bottom insert 202 as shown in FIG. 2B. This feature is useful if the user sets the cup or glass down on the corrugated bottom 200 or insert 202 while it is being filled. Any liquid in the reservoir will not cover the bottom of the cup or glass.

Figure 3A:
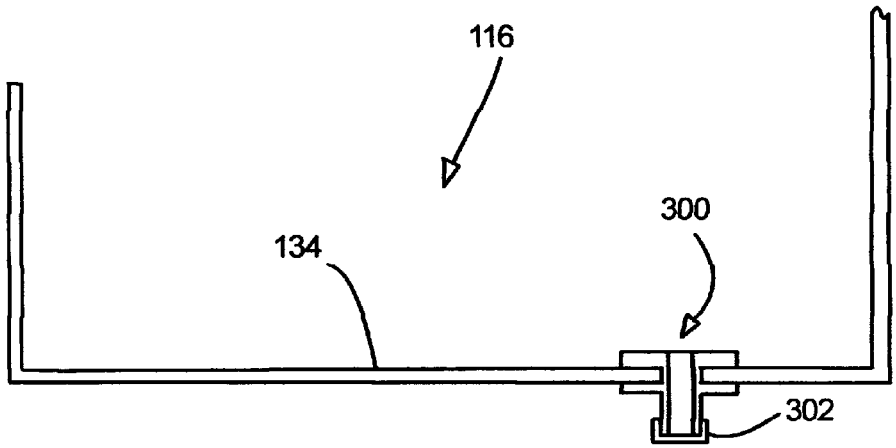
FIG. 3A shows a liquid exit means in the liquid receiving device.
Figure 3B:
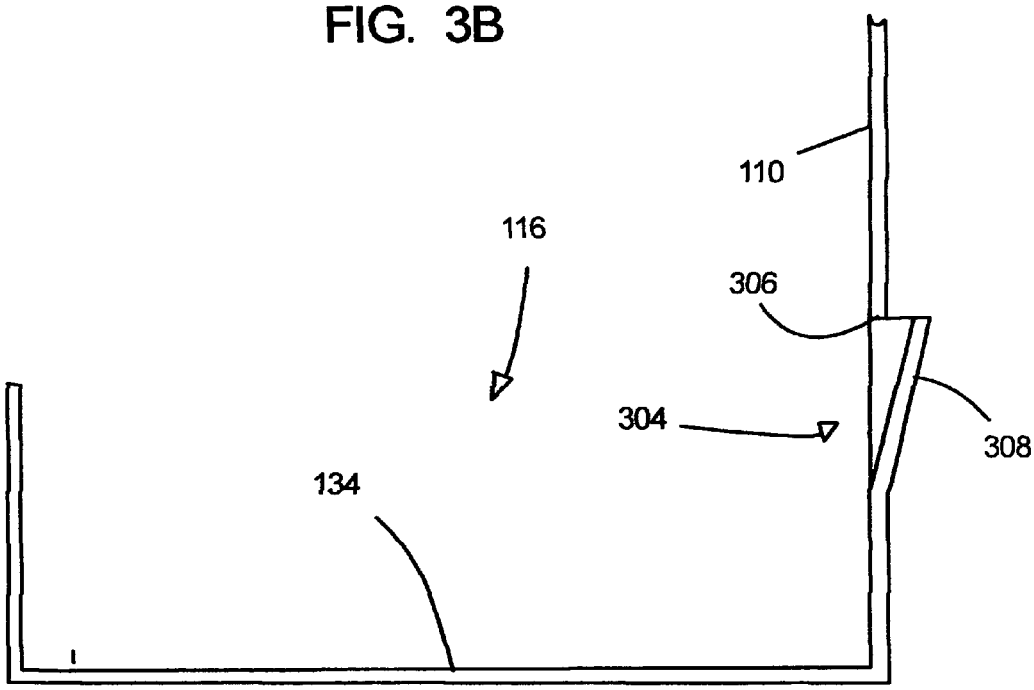
FIG. 3B shows a liquid exit means in the vertical support member.

FIG. 3A shows a liquid exit means 300 in the liquid receiving device 116 in the bottom 134. A door or cap 302 is used to prevent drainage therefrom until an appropriate container is placed under the drain. FIG. 3B shows a liquid exit means 304 by cross section in the vertical support member 110. A horizontal slot 306 is partially cut in the vertical support member 110 and the lower wall 308 is pushed backward to form a trough. The vertical support member 110 is rotated clockwise and any liquid in the reservoir will flow to the back and down into the trough to an appropriate container for waste. If there are adequate sidewalls on the vertical support member 110, the slot 306 may cross completely the member 110 thus eliminating the need for the trough as the liquid will drain through the slot 306.

Figure 4:
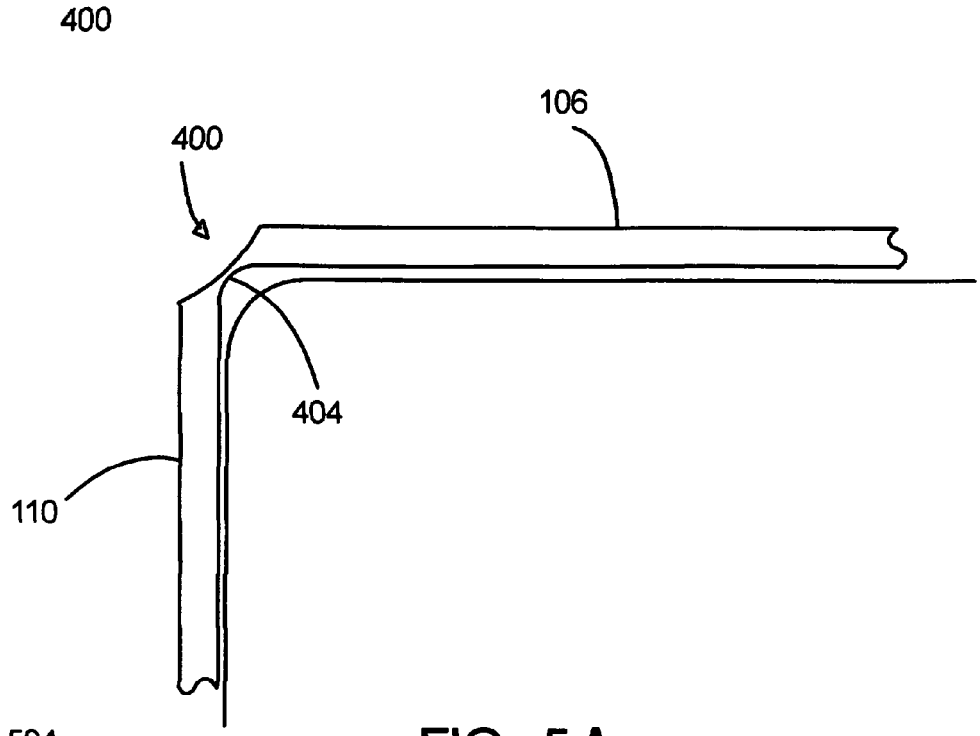
FIG. 4 illustrates by a side view a further embodiment of a plastic hinge between the horizontal and vertical support members of the present invention.

Referring to FIG. 4, a means for connecting 400 being a flexible plastic hinge 402 is positioned between the horizontal support member 106 and the vertical support member 110. The flexible plastic hinge 402 has a connecting bridge 404 of substantially less thickness than the materials of the support members so as to be flexible about a horizontal line.

Figure 5A:
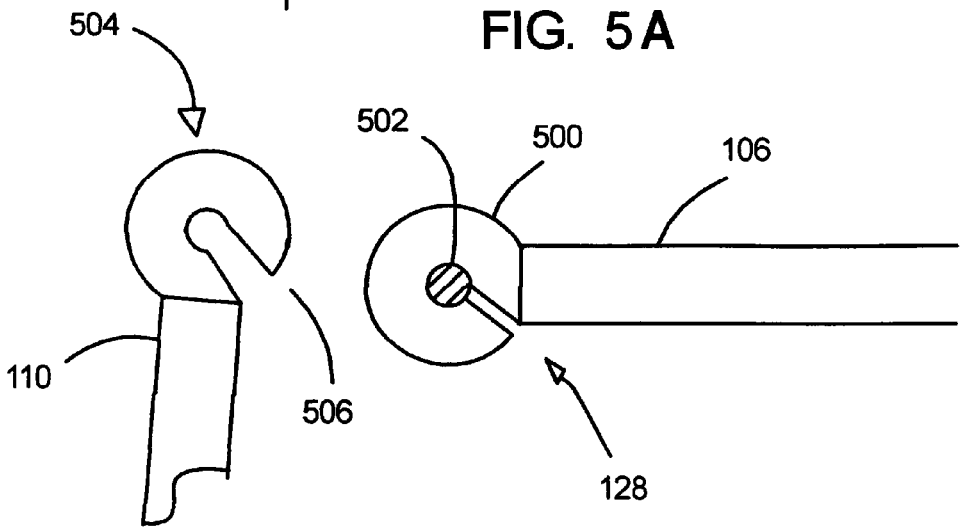
FIG. 5A illustrates by a side view another embodiment of a connecting means being a tubular hook of the vertical support member being inserted onto a hinge pin of the horizontal support member of the present invention.

Referring to FIG. 5A, one of the tubular members 500 of the hinge 128 is shown having a pin 502 therein. Tubular member 500 is a part of the horizontal support member 106. The pin 502 is exposed in several spaces between or next to the tubular members 500. A tubular hook 504 being a part of the vertical support member 110 is formed to have a downward facing space 506 sufficiently wide to accept the pin 502. Thus, the vertical support member 110 may be attached to or removed and the liquid emptied from the reservoir 118 as needed.

Figure 5B:
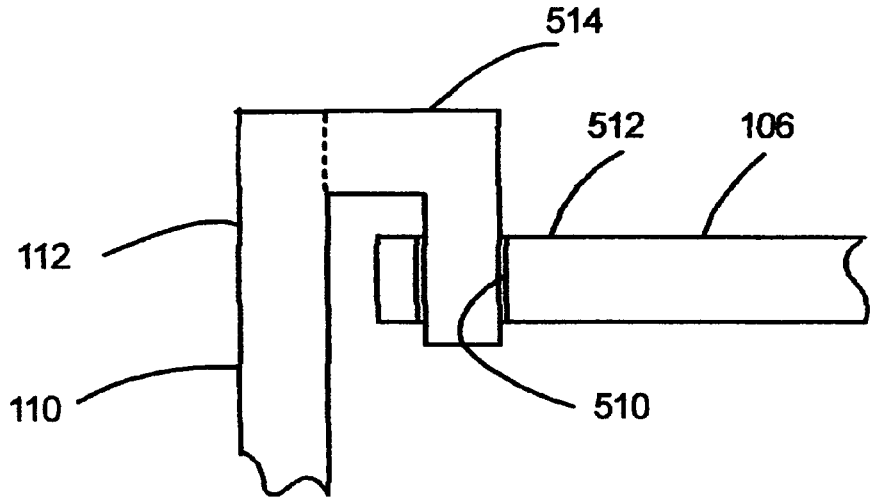
FIG. 5B illustrates by a side view another embodiment of a connecting means being a hook of the vertical support member being inserted into an aperture of horizontal support member of the present invention.

Referring to FIG. 5B, another connecting means is shown. Several rectangular voids or apertures 510, one shown, are formed in the front side end 512 of the horizontal support member 106. Several hooks 514, only one shown, are formed on the top section 112 of the vertical support member 110. These hooks 514 are formed to be able to enter into the voids 510. Again, the vertical support member 110 may be attached or may be removed to empty the reservoir of any liquid.

Figure 5C:
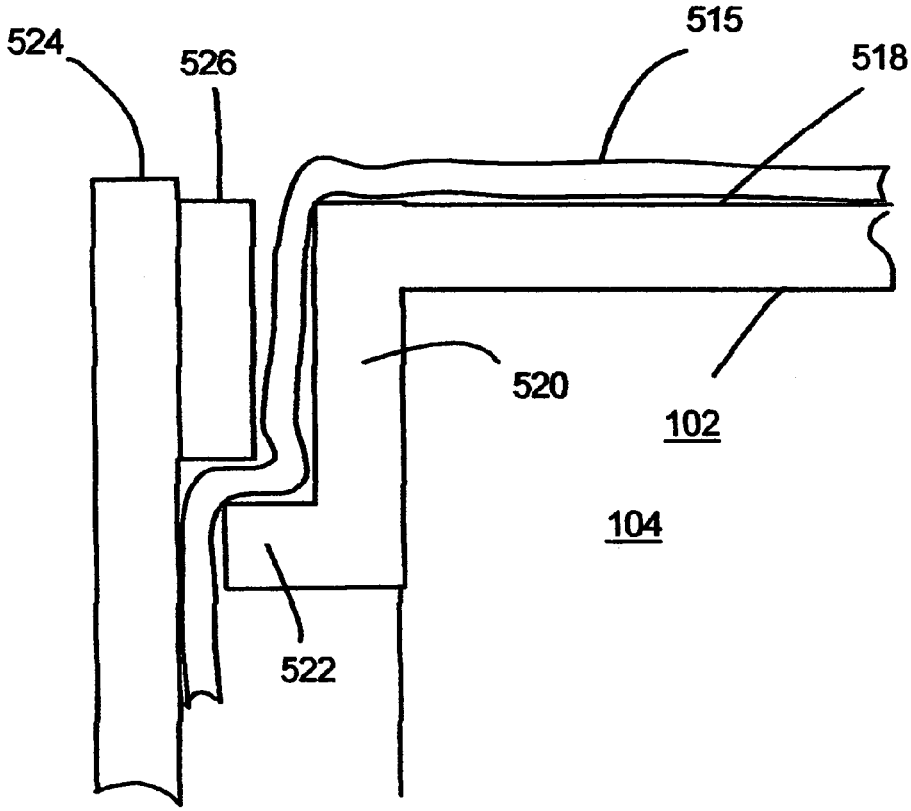
FIG. 5C illustrates by a side view another embodiment of a connecting means being a magnet attaching means for the horizontal and vertical support members of the present invention.

Referring to FIG. 5C, the table 104 is shown with a table cloth or sheet 515 being placed thereon. A horizontal support member 518 is placed on the top surface 102. The support member 518 has a flange 520 being perpendicular thereto. At the bottom of the flange 520 is a lip 522 being horizontal in direction and perpendicular to the flange 520. After the support member 518 is placed on the table 104, the sheet 515 is placed thereover. In order to attach a vertical support member 524, one or more magnets 526 are attached along the top edge of the support member 524. These magnets 526 are then removably attached to the flange 520 with the sheet 515 therebetween. The lip 522 prevents the vertical support member 524 from slipping off of the horizontal support member 518. Again, the vertical support member 524 may be removed to empty the reservoir, not shown, of any liquid as needed.

Figure 6:
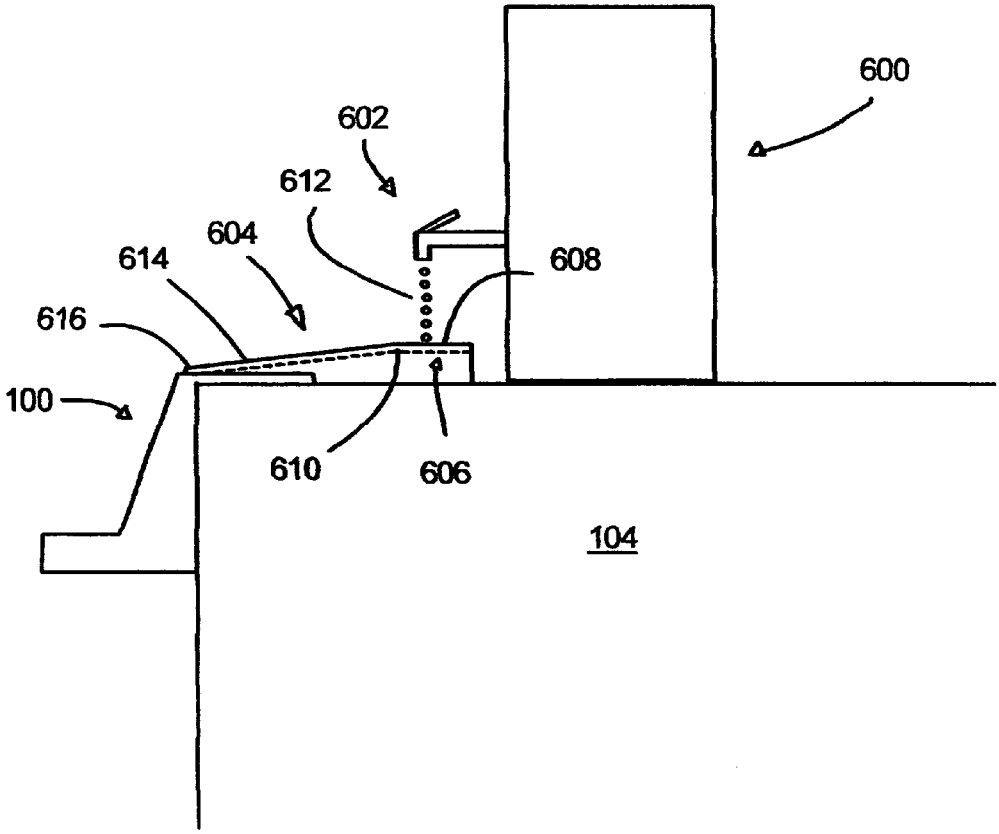
FIG. 6 illustrates by a side view a trough between a liquid dispenser and the liquid capture device of the present invention.

Referring to FIG. 6, a liquid dispenser 600 may be positioned away from the edge of the table 104 to prevent accidental spills. In order to use the liquid capture device 100 of the present invention for this embodiment, a slanted trough 604, a channeling device, is positioned thereon with a top end 606, a first end, placed under a spigot 602, a flow control device. A slightly slanting surface 608 having a slight trough 610 therein, a dotted line representing the bottom of the trough 610, may be used for the placement of cups and glasses. Any drips 612 falling on the top end 606 run down the trough 614 to a bottom end 616, a second end, where the liquid falls into the reservoir of the liquid capture device 100.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An improved liquid capture device for use with a liquid dispenser, the liquid dispenser being positioned upon a support surface when in use, said improved liquid capture device comprising:

a horizontal support member, said horizontal support member being a panel having a flat bottom side, said flat bottom side being in contact with the support surface when in use, wherein said horizontal support member comprises said panel having a front side edge;

a vertical support member having a top and bottom section, wherein said vertical support member has said means for flexibly connecting attached to the top section, said vertical support member having sidewalls attached to vertical outer edges of said vertical support member and protruding thereover for channeling fluid into a reservoir;

a liquid receiving device, said liquid receiving device being attached to the bottom section of said vertical support member, said liquid receiving device providing said reservoir into which certain liquid from said liquid dispenser may be collected; and a hinge for flexibly connecting said vertical support member to said horizontal support member, wherein said hinge for connecting is a flexible hinge having a flexible connecting plastic bridge connected to said top section of said vertical support member and to said front side edge of said horizontal support member.

* * * * *